US007066620B1

(12) United States Patent
Millet

(10) Patent No.: US 7,066,620 B1
(45) Date of Patent: Jun. 27, 2006

(54) NOVELTY ITEM FOR COOPERATING WITH A CAP OF A BOTTLE SUBSEQUENT TO COOPERATION OF THE CAP WITH A BOTTLE OPENER BUT PRIOR TO COOPERATION OF THE CAP WITH A CAP CATCHER

(76) Inventor: Warren Millet, 595 Bryceland Blvd., Ridgeland, MS (US) 39157

( * ) Notice: Subject to any disclaimer, the term of this patent is extended or adjusted under 35 U.S.C. 154(b) by 118 days.

(21) Appl. No.: 10/917,671

(22) Filed: Aug. 14, 2004

Related U.S. Application Data

(60) Provisional application No. 60/587,985, filed on Jul. 13, 2004.

(51) Int. Cl.
*F21V 33/00* (2006.01)

(52) U.S. Cl. ..... 362/154; 362/249; 362/253; 362/457

(58) Field of Classification Search ..... 362/154–155, 362/642, 646, 652, 240, 249, 251, 362, 375, 362/253, 451, 227, 368, 457, 458, 800; 193/7–8, 193/15, 2 A; 232/13
See application file for complete search history.

(56) References Cited

U.S. PATENT DOCUMENTS

| | | | | | |
|---|---|---|---|---|---|
| 1,042,458 | A | * | 10/1912 | McAllister | 232/17 |
| 2,696,285 | A | * | 12/1954 | Zenlea | 193/45 |
| 3,028,073 | A | * | 4/1962 | Boxshall et al. | 232/13 |
| 6,086,216 | A | | 7/2000 | Goldfarb | |
| 6,135,606 | A | | 10/2000 | Fernandez et al. | |
| 6,158,870 | A | | 12/2000 | Ramirez | |
| 6,186,637 | B1 | | 2/2001 | Murrietta | |
| 6,254,247 | B1 | | 7/2001 | Carson | |
| 2003/0103347 | A1 | * | 6/2003 | Friend | 362/225 |

* cited by examiner

*Primary Examiner*—Sandra O'Shea
*Assistant Examiner*—Guiyoung Lee
(74) *Attorney, Agent, or Firm*—Jacobson Holman PLLC

(57) ABSTRACT

A novelty item for cooperating with a cap of a bottle subsequent to cooperation of the cap with a bottle opener, but prior to cooperation of the cap with a cap catcher. The novelty item includes a body, electrical circuitry, and a plurality of lights. The electrical circuitry electrically communicates with the plurality of lights. The plurality of lights are disposed along the body. The electrical circuitry causes a light to flash. The novelty item also works with any item similar to the cap, i.e., a disk, e.g., a 25¢ piece. The cap catcher is placed on a bar with the novelty item resting thereon and thereabove. A patron throws 25¢ pieces into the novelty item as a tip and watches the 25¢ pieces cause the novelty item to operate.

32 Claims, 7 Drawing Sheets

NOVELTY ITEM FOR COOPERATING WITH A CAP OF A BOTTLE SUBSEQUENT TO COOPERATION OF THE CAP WITH A BOTTLE OPENER BUT PRIOR TO COOPERATION OF THE CAP WITH A CAP CATCHER

CROSS REFERENCE TO RELATED APPLICATIONS

The instant non-provisional application claims priority from provisional application No. 60/587,985, filed on Jul. 13, 2004, applicant Warren Millet, and entitled CAPDROP,

BACKGROUND OF THE INVENTION

1. Field of the Invention

The present invention relates to a novelty item for cooperating with a cap of a bottle, and more particularly, the present invention relates to a novelty item for cooperating with a cap of a bottle subsequent to cooperation of the cap with a bottle opener but prior to cooperation of the cap with a cap catcher.

2. Description of the Prior Art

The need for bottle openers starts with the bottle cap. Today, bottle openers can be found in a variety of styles and configurations.

Cork and wood bottle stoppers are known to be the oldest bottle caps. Even today most wine bottles use cork to seal the bottles. By the middle of the 19th Century the use of glass bottles and jars was on the rise and so was the development of bottle closures. In 1856, a screw cap was invented with a cork disc attached to seal glass jars. From 1856 to around 1915, most beer bottles used a wire attached mechanical cap. This style of cap is still being used with some modifications.

The origins of the bottle cap as we know it started in 1890 with William Painter. Painter came up with a one-time use cap with a cork lining he called crown cork since it resembled the British Queen's crown. This type of bottle cap is still in wide use today by the beer industry.

The invention in the early 1900s of mass production of glass bottles led to an increase in the use of crown caps. In addition, further growth came from other containers being converted to bottles in order to make use of the crown cap. Within 20 years nearly all soft drink and beer bottles were sporting crown caps.

During the 1960s, the advent of less expensive synthetic materials and sparse cork resources lead to the replacement of the cork lining in crown caps with plastic. In addition, some of the crown caps have been replaced with twist-offs that don't require a separate opener.

Today aluminum and plastic pilfer proof (PP) caps have replaced most of the crown caps on glass and plastic beverage containers. Most beer bottles still use either one-time use or twist-off crown style caps.

The use of bottle opening devices is known in the prior art. More specifically, bottle opening devices heretofore devised and utilized for the purpose of removing caps from bottles are known to consist basically of familiar, expected, and obvious structural configurations, notwithstanding the myriad of designs encompassed by the crowded prior art which have been developed for the fulfillment of countless objectives and requirements.

It would be entertaining to have a novelty item for cooperating with a cap of a bottle subsequent to cooperation of the cap with a bottle opener but prior to cooperation of the cap with a cap catcher.

Numerous innovations for bottle/light related devices have been provided in the prior art. Even though these innovations may be suitable for the specific individual purposes to which they address, they each differ in structure and/or operation and/or purpose from the present invention in that they do not provide a novelty item for cooperating with a cap of a bottle subsequent to cooperation of the cap with a bottle opener but prior to cooperation of the cap with a cap catcher.

FOR EXAMPLE, U.S. Pat. No. 6,086,216 to Goldfarb teaches a portable lighting device comprising a water bottle formed of a light transmitting material and a lamp case fitted to the open end of the water bottle. A light bulb is positioned within the lamp case and a light transmitting lens is positioned between the light bulb and the interior of the water bottle whereby light emitted from the light bulb is transmitted through the lens to the interior of the water bottle and is diffused through the wall of the water bottle. A method for illuminating a space is provided in which water is introduced into a bottle so that the bottle is at least partially filled and the bottle is sealingly and releasably attached to a source of light.

ANOTHER EXAMPLE, U.S. Pat. No. 6,135,606 to Fernandez et al. teaches a hand held toy to hold translucent Lollypops or other similar sucker candies producing illumination from the interior of the candy in such a way that tiny light spots blink varying in color and position to increase children amusement while using the holder with the candy. It has a battery powered light emitting source controlled by a sensible pushbutton switch, and is securely and hermetically assembled and made of smooth surface finishing rounded shaped and resistant parts being completely washable to guarantee its hygienic and safe use by little children. It can be provided with a protecting cover to keep the candy from dust, insects, and microbes. It can be provided with small transparent or colored lenses above the light emitting source, so that small colored light beams are projected upwards toward the lower surface of the translucent colored sucker candy attached to the holder, producing an attractive glowing effect and improving the user's amusement. Alternatively, it can be transformed into a blinking varying color spot lighted pacifier attaching to it a pacifier cap. It also can be used as a baby entertaining toy hanging it in any safe place of the cradle. The toy can be designed in different shapes and colors, so can the candies, which can have a wide variety of flavors, colors, and shapes, such as balls, discs, stars, polygons, clown heads, flowers, etc. In addition, as many other similar toys, it can be provided with sound, rotation, and vibration motions, etc., by adding the appropriate devices or mechanisms. This type of toy can be useful to administer to little children certain medicines which can be candy like produced. In one of its possible embodiments, it could also be used as a little pocket flashlight. The whole set can be kept in a especially decorated plastic case.

STILL ANOTHER FOR EXAMPLE, U.S. Pat. No. 6,158,870 to Ramirez teaches a nursing baby bottle attachment with (an) entertainment device(s) associated therewith, especially the options of both, or either, chosen jingles of music and randomly flashing lights. Such may be just the music, or the paired music and lights with a micro-switch to turn off the lights alone.

YET ANOTHER FOR EXAMPLE, U.S. Pat. No. 6,186,637 to Murrietta teaches a combination baby bottle and amusement device. The baby bottle has a hollow cylindrical body and a bladder that holds the feeding liquid. The device is adapted to frictionally fit into an open end of the cylinder opposite a feeding nipple. The device projects light beams into the liquid filled bladder and also produces a sound show. The device projects a single or multiple light beams that change color, shape, intensity, and blink synchronously with time. The light and sound show entertain the baby while it is feeding and may also pacify and arouse the baby.

STILL YET ANOTHER FOR EXAMPLE, U.S. Pat. No. 6,254,247 to Carson teaches a disposable liquid beverage container comprising a first compartment for sealably containing a beverage and a second compartment adjacent the first compartment. A barrier having a translucent portion separates the first and second compartments. A light source and an energy source electrically connected to the light source are disposed in the second compartment. A switch activates the light source, such that the light source shines through the translucent portion of the barrier and illuminates the beverage disposed in the first compartment of the container. A holographic image embedded in a film attached to an outside of the container is created within the first compartment when the light source is illuminated. Methods are also provided.

It is apparent that numerous innovations for bottle/light related devices have been provided in the prior art that are adapted to be used. Furthermore, even though these innovations may be suitable for the specific individual purposes to which they address, they would not be suitable for the purposes of the present invention as heretofore described.

SUMMARY OF THE INVENTION

ACCORDINGLY, AN OBJECT of the present invention is to provide a novelty item for cooperating with a cap of a bottle subsequent to cooperation of the cap with a bottle opener but prior to cooperation of the cap with a cap catcher that avoids the disadvantages of the prior art.

ANOTHER OBJECT of the present invention is to provide a novelty item for cooperating with a cap of a bottle subsequent to cooperation of the cap with a bottle opener but prior to cooperation of the cap with a cap catcher that is simple to use.

BRIEFLY STATED, STILL ANOTHER OBJECT of the present invention is to provide a novelty item for cooperating with a cap of a bottle subsequent to cooperation of the cap with a bottle opener but prior to cooperation of the cap with a cap catcher. The novelty item includes a body, electrical circuitry, and a plurality of lights. The electrical circuitry electrically communicates with the plurality of lights. The plurality of lights are disposed along the body. The electrical circuitry causes a light to flash. The novelty item also works with any item similar to the cap, i.e., a disk, e.g., a 25¢ piece. The cap catcher is placed on a bar with the novelty item resting thereon and thereabove. A patron throws 25¢ pieces into the novelty item as a tip and watches the 25¢ pieces cause the novelty item to operate.

The novel features which are considered characteristic of the present invention are set forth in the appended claims. The invention itself, however, both as to its construction and its method of operation, together with additional objects and advantages thereof, will be best understood from the following description when read and understood in connection with the accompanying drawings.

BRIEF DESCRIPTION OF THE DRAWINGS

The figures of the drawings are briefly described as follows.

LIST OF REFERENCE NUMERALS UTILIZED IN THE DRAWINGS

Figure 1:
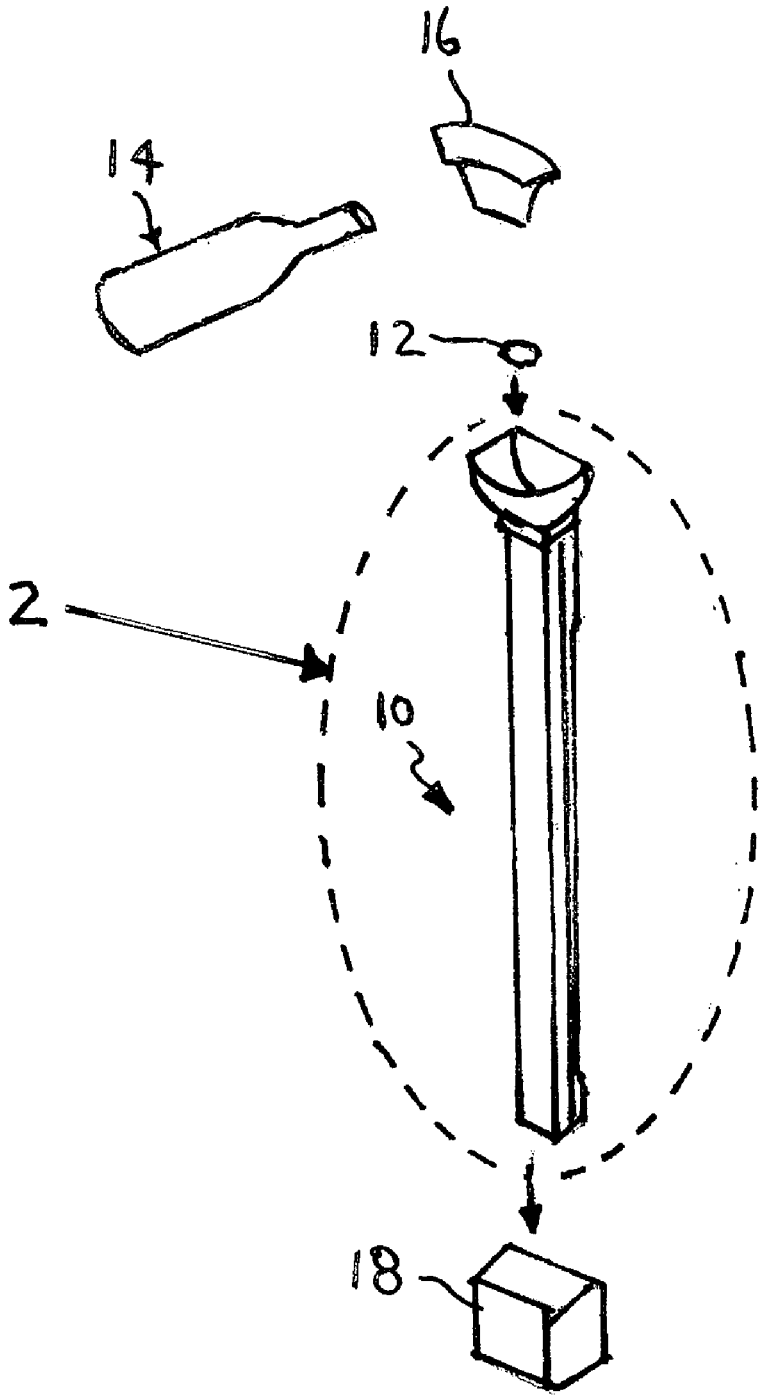
FIG. 1 is a diagrammatic perspective view of the novelty item of the present invention cooperating with a cap of a bottle subsequent to cooperation of the cap with a bottle opener but prior to cooperation of the cap with a cap catcher.

10 novelty item of present invention for cooperating with cap 12 of bottle 14 subsequent to cooperation of cap 12 with bottle opener 16 but prior to cooperation of cap 12 with cap catcher 18
12 cap of bottle 14
14 bottle
16 bottle opener
18 cap catcher
20 body
22 electrical circuitry
24 plurality of lights
26 uppermost end of body 20
28 lowermost end of body 20
30 four walls of body 20
32 first wall of four walls 30 of body 20
34 second wall of four walls 30 of body 20
36 third wall of four walls 30 of body 20
38 fourth wall of four walls 30 of body 20
42 interior surface of first wall 32 of body 20
44 interior surface of second wall 34 of body 20
46 interior surface of third wall 36 of body 20
48 interior surface of fourth wall 38 of body 20
50 plurality of deflection ribs of body 20
52 PC board of electrical circuitry 22
54 optical or proximity sensor of electrical circuitry 22
56 controller of electrical circuitry 22
58 light driver of electrical circuitry 22
60 power supply interface of electrical circuitry 22
62 cover of electrical circuitry 22

64 pattern select switch of electrical circuitry 22
66 panel of electrical circuitry 22
68 plurality of through bores in panel 66 of electrical circuitry 22
70 plurality of through bores in fourth wall 38 of body 20
72 head
74 body of head 70
76 collar of head 70
78 attaching apparatus
79 surface of body 74 of head 70
80 female portion of attaching apparatus 78
82 male portion of attaching apparatus 78
84 mounting apparatus
86 pair of through bores in surface 79 of body 74 of head 72 of mounting apparatus 84

DETAILED DESCRIPTION OF THE INVENTION

Referring now to the figures, in which like numerals indicate like parts, and particularly to FIG. 1, which is a diagrammatic perspective view of the novelty item of the present invention cooperating with a cap of a bottle subsequent to cooperation of the cap with a bottle opener but prior to cooperation of the cap with a cap catcher, the novelty item of the present invention is shown generally at 10 for cooperating with a cap 12 of a bottle 14 subsequent to cooperation of the cap 12 with a bottle opener 16 but prior to cooperation of the cap 12 with a cap catcher 18.

Figure 2:
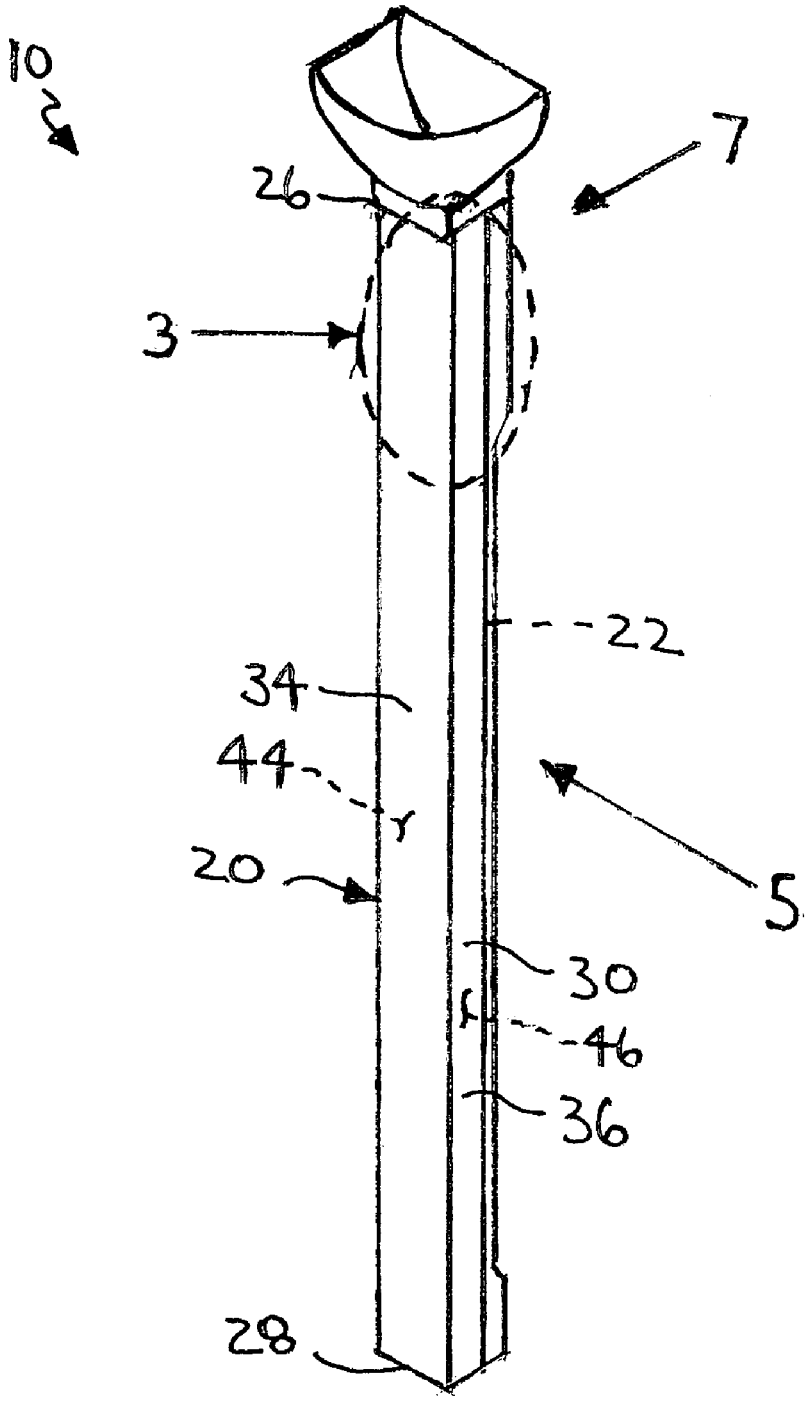
FIG. 2 is an enlarged diagrammatic perspective view of the area generally enclosed by the dotted curve identified by ARROW 2 in FIG. 1 of the novelty item of the present invention.
Figure 3:
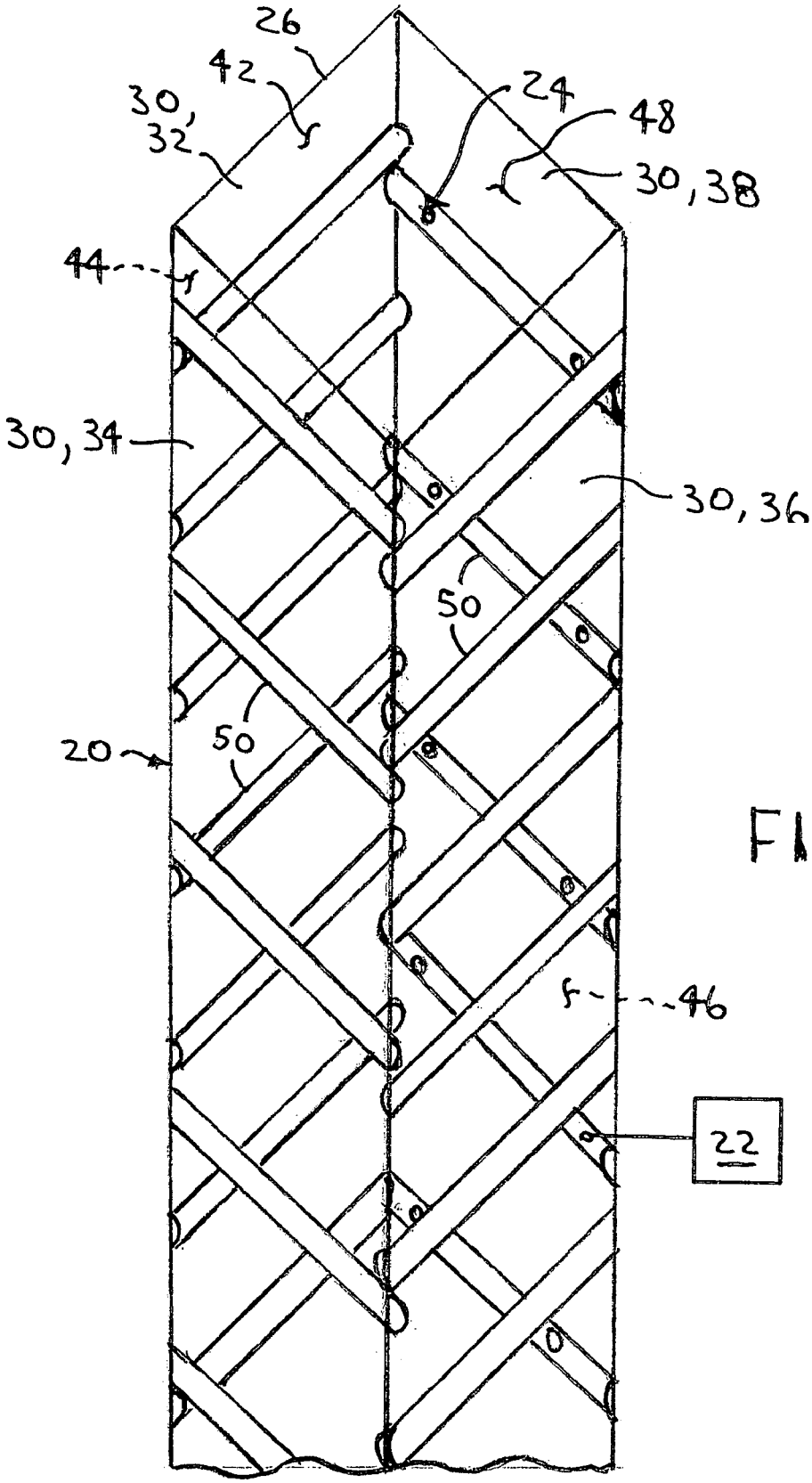
FIG. 3 is an enlarged diagrammatic perspective view of the area generally enclosed by the dotted curve identified by ARROW 3 in FIG. 2 of a portion of the body of the novelty item of the present invention.

The overall configuration of the novelty item 10 can best be seen in FIGS. 2 and 3, which are, respectively, an enlarged diagrammatic perspective view of the area generally enclosed by the dotted curve identified by ARROW 2 in FIG. 1 of the novelty item of the present invention, and an enlarged diagrammatic perspective view of the area generally enclosed by the dotted curve identified by ARROW 3 in FIG. 2 of a portion of the body of the novelty item of the present invention, and as such, will be discussed with reference thereto.

The novelty item 10 comprises a body 20, electrical circuitry 22, and a plurality of lights 24. The electrical circuitry 22 electrically communicates with the plurality of lights 24. The plurality of lights 24 are disposed along the body 20. The electrical circuitry 22 causes a light 24 to flash.

Figure 4:
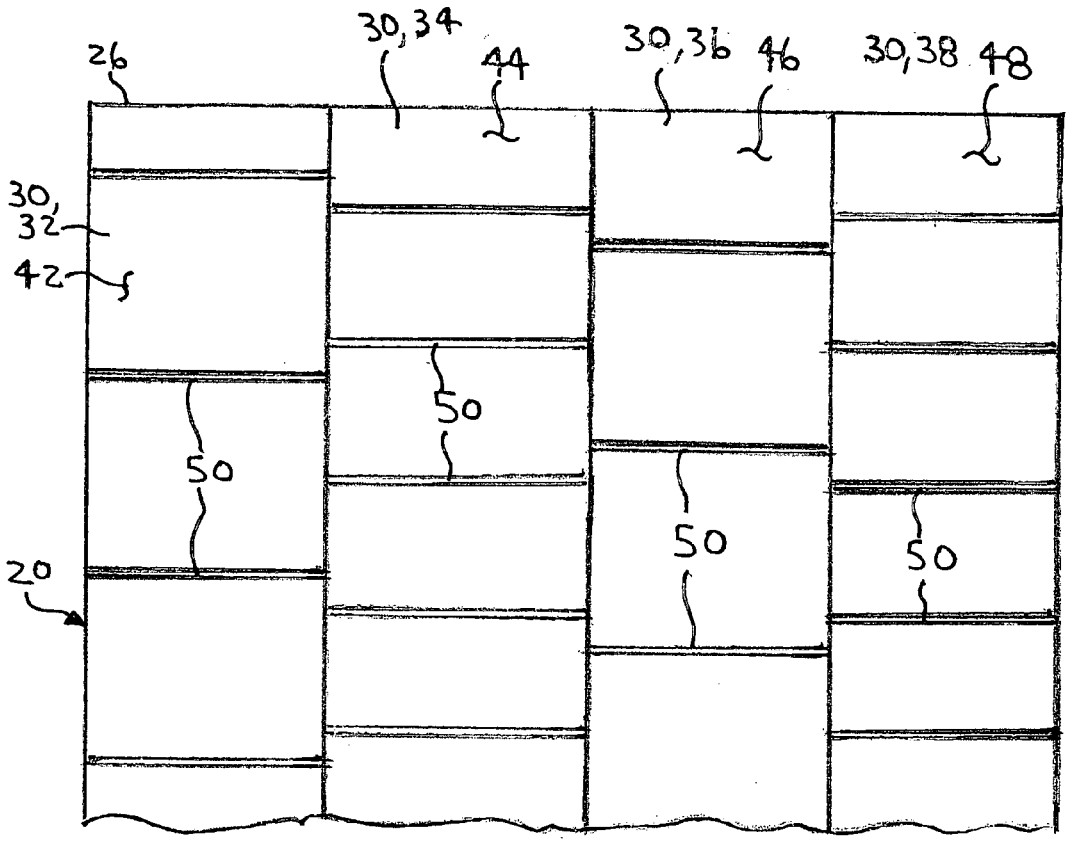
FIG. 4 is a diagrammatic view of the portion of the body of the novelty item of the present invention shown in FIG. 3 unfolded.

The specific configuration of the body 20 can best be seen in FIGS. 2–4, which are, respectively, an enlarged diagrammatic perspective view of the area generally enclosed by the dotted curve identified by ARROW 2 in FIG. 1 of the novelty item of the present invention, an enlarged diagrammatic perspective view of the area generally enclosed by the dotted curve identified by ARROW 3 in FIG. 2 of a portion of the body of the novelty item of the present invention, and a diagrammatic view of the portion of the body of the novelty item of the present invention shown in FIG. 3 unfolded, and as such, will be discussed with reference thereto.

The body 20 is slender, elongated, and square-shaped in lateral cross section and vertically-oriented and hollow for allowing the cap 12 to fall therethrough by gravity.

The body 20 has an uppermost end 26 and a lowermost end 28. The uppermost end 26 of the body 20 and the lowermost end 28 of the body 20 are open for allowing the cap 12 to enter the body 20 through the uppermost end 26 of the body 20 and then exit the body 20 through the lowermost end 28 of the body 20.

The body 20 further has four walls 30. The four walls 30 of the body 20 are so positioned so as to provide the square-shaped lateral cross section, and include a first wall 32, a second wall 34, a third wall 36, and a fourth wall 38.

The four walls 30 of the body 20 are oriented with the first wall 32 of the body 20 and the third wall 36 of the body 20 opposing each other and with the second wall 34 of the body 20 and the fourth wall 38 of the body 20 opposing each other.

The first wall 32 of the body 20 has an interior surface 42, the second wall 34 of the body 20 has an interior surface 44, the third wall 36 of the body 20 has an interior surface 46, and the fourth wall 38 of the body 20 has an interior surface 48.

The body 20 further has a plurality of deflection ribs 50. The plurality of deflection ribs 50 of the body 20 extend along the interior surface 42 of the first wall 32 of the body 20, the interior surface 44 of the second wall 34 of the body 20, the interior surface 46 of the third wall 36 of the body 20, and the interior surface 48 of the fourth wall 38 of the body 20.

Each deflection rib 50 of the body 20 is slender, elongated, horizontally-oriented, and spaced-apart from an adjacent deflection rib 50 of the body 20.

The plurality of deflection ribs 50 of the body 20 are so positioned along the interior surface 42 of the first wall 32 of the body 20, the interior surface 44 of the second wall 34 of the body 20, the interior surface 46 of the third wall 36 of the body 20, and the interior surface 48 of the fourth wall 38 of the body 20 so as to cause the cap 12 to contact them and ricochet thereoff as the cap 12 travels down the body 20, with the electrical circuitry 22 causing a light 24 to flash.

The specific positioning of the deflection ribs 50 of the body 20 to accomplish the function supra is as follows.

The First Wall 32 of the Body 20

An uppermost deflection rib 50 of the body 20 on the interior surface 42 of the first wall 32 of the body 20 is positioned ½" below the uppermost end 26 of the body 20. Remaining deflection ribs 50 of the body 20 on the interior surface 42 of the first wall 32 of the body 20 are positioned at 1½" intervals therebelow.

The Second Wall 34 of the Body 20

An uppermost deflection rib 50 of the body 20 on the interior surface 44 of the second wall 34 of the body 20 is positioned ¾" below the uppermost end 26 of the body 20. Remaining deflection ribs 50 of the body 20 on the interior surface 44 of the second wall 34 of the body 20 are positioned at 1" intervals therebelow.

The Third Wall 36 of the Body 20

An uppermost deflection rib 50 of the body 20 on the interior surface 46 of the third wall 36 of the body 20 is positioned 1" below the uppermost end 26 of the body 20. Remaining deflection ribs 50 of the body 20 on the interior surface 46 of the third wall 36 of the body 20 are positioned at 1½" intervals therebelow.

The Fourth Wall 38 of the Body 20

An uppermost deflection rib 50 of the body 20 on the interior surface 48 of the fourth wall 38 of the body 20 is positioned ¾" below the uppermost end 26 of the body 20.

Remaining deflection ribs 50 of the body 20 on the interior surface 48 of the fourth wall 38 of the body 20 are positioned at 1" intervals therebelow.

The measurements supra are summarized in TABLE I infra.

TABLE I

| WALL OF BODY 20 | DISTANCE OF UPPERMOST DEFLECTION RIB 50 OF BODY 20 BELOW UPPERMOST END 26 OF BODY 26 (INCHES) | DISTANCE OF INTERVALS OF REMAINING DEFLECTION RIBS 50 OF BODY 20 (INCHES) |
|---|---|---|
| First 32 | ½ | 1½ |
| Second 34 | ¾ | 1 |
| Third 36 | 1 | 1½ |
| Fourth 38 | ¾ | 1 |

Each deflection rib 50 of the body 20 has a lateral cross sectional shape for facilitating the ricocheting, such as, but not limited to, generally hemispherical, tapered, or the like.

The deflection ribs 50 of the body 20 on the interior surface 44 of the second wall 34 of the body 20 and the deflection ribs 50 of the body 20 on the interior surface 48 of the fourth wall 38 of the body 20 have one-to-one correspondence elevations.

Figure 5:
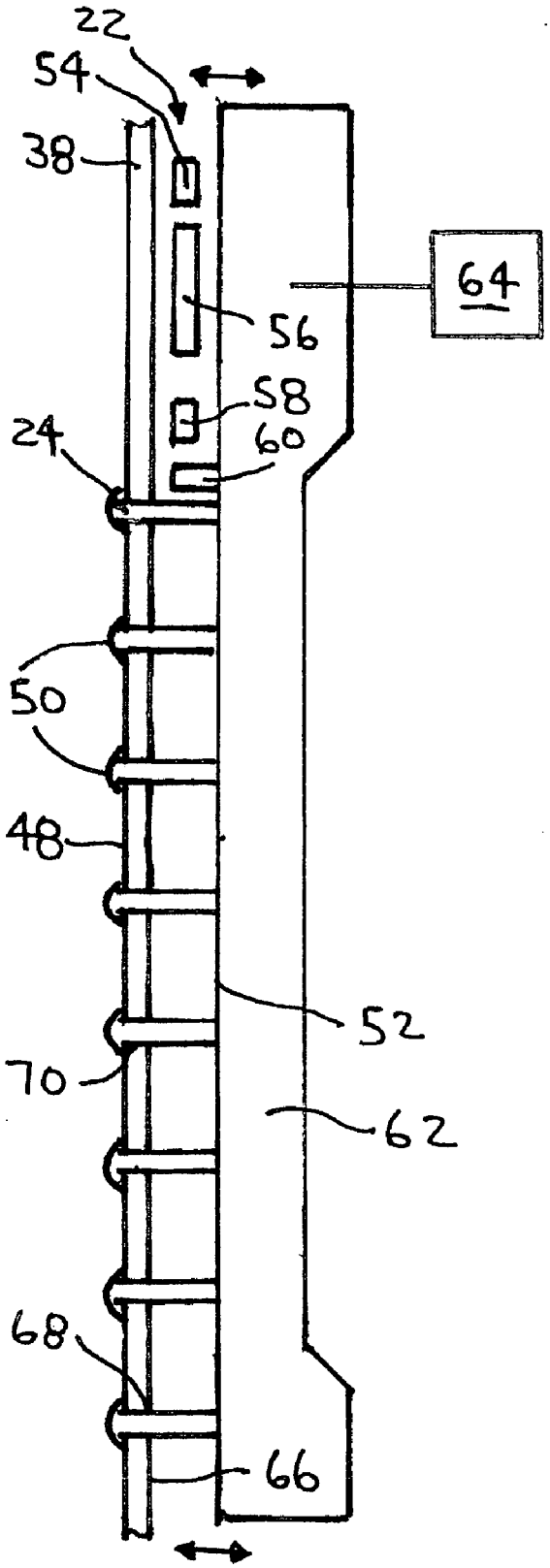
FIG. 5 is an enlarged diagrammatic side elevational view taken generally in the direction of ARROW 5 in FIG. 2.
Figure 6:
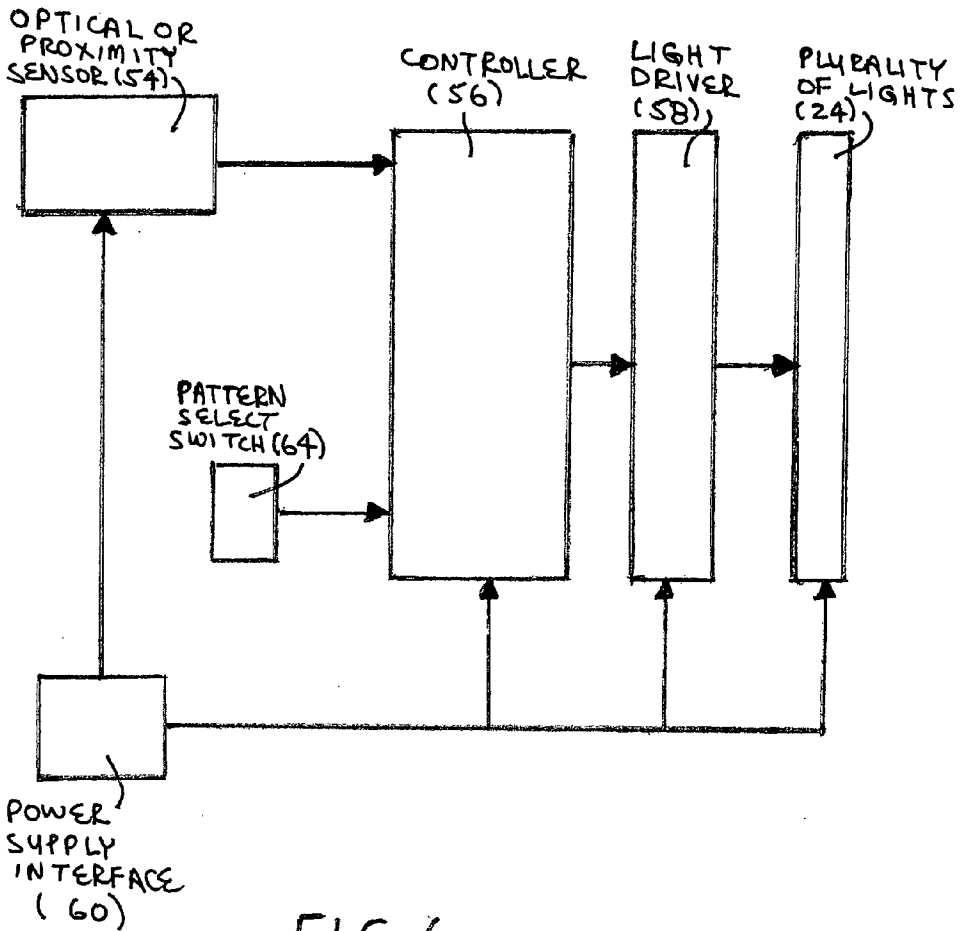
FIG. 6 is a block diagram of the circuit of the novelty item of the present invention.

The specific configuration of the electrical circuitry 22 and the plurality of lights 24 can best be seen in FIGS. 5 and 6, which are, respectively, an enlarged diagrammatic side elevational view taken generally in the direction of ARROW 5 in FIG. 2 and a block diagram of the circuit of the novelty item of the present invention, and as such, will be discussed with reference thereto.

The electrical circuitry 22 comprises a PC board 52, an optical or proximity sensor 54, a controller 56, a light driver 58, and a power supply interface 60.

The PC board 52 of the electrical circuitry 22 is spaced behind, and extends along, the fourth wall 38 of the body 20. The optical or proximity sensor 54 of the electrical circuitry 22 is disposed on the PC board 52 of the electrical circuitry 22, at an elevation of the uppermost end 26 of the body 20, and activates the electrical circuitry 22 when triggered by the cap 12 passing thereby. The controller 56 of the electrical circuitry 22 is disposed on the PC board 52 of the electrical circuitry 22 and electrically communicates with the optical or proximity sensor 54 of the electrical circuitry 22. The light driver 58 of the electrical circuitry 22 is disposed on the PC board 52 of the electrical circuitry 22 and electrically communicates with the controller 56 of the electrical circuitry 22 and the plurality of lights 24.

The power supply interface 60 of the electrical circuitry 22 is disposed on the PC board 52 of the electrical circuitry 22 and electrically communicates with the optical or proximity sensor 54 of the electrical circuitry 22, the controller 56 of the electrical circuitry 22, the light driver 58 of the electrical circuitry 22, and the plurality of lights 24.

The electrical circuitry 22 further comprises a cover 62. The cover 62 of the electrical circuitry 22 replaceably attaches to the fourth wall 38 of the body 20 and covers, so as to protect, the electrical circuitry 22.

The electrical circuitry 22 further comprises a pattern select switch 64. The pattern select switch 64 of the electrical circuitry 22 is disposed on the PC board 52 of the electrical circuitry 22, electrically communicates with the controller 56 of the electrical circuitry 22, extends through the cover 62 of the electrical circuitry 22, and selectively changes pattern of illumination of the plurality of lights 24 if desired.

The electrical circuitry 22 further comprises a panel 66. The panel 66 of the electrical circuitry 22 is disposed between the PC board 52 of the electrical circuitry 22 and, and along, the fourth wall 38 of the body 20, and has a plurality of through bores 68.

The fourth wall 38 of the body 20 has a plurality of through bores 70. The plurality of through bores 70 in the fourth wall 38 of the body 20 are in one-to-one alignment with the plurality of through bores 68 in the panel 66 of the electrical circuitry 22.

The plurality of lights 24 are preferably LEDs, but are not limited to that, and can be any other form of lights, without departing in any way from the spirit of the present invention.

The plurality of lights 24 are disposed on the PC board 52 of the electrical circuitry 22, electrically communicate with the light driver 58 of the electrical circuitry 22, and extend inwardly from the PC board 52 of the electrical circuitry 22 through the plurality of through bores 68 in the panel 66 of the electrical circuitry 22 that are aligned therewith, through the plurality of through bores 70 in the fourth wall 38 of the body 20, and into the deflection ribs 50 of the body 20 on the interior surface 48 of the fourth wall 38 of the body 20.

The plurality of lights 24 are so arranged so as to allow a pair of lights 24 to be disposed on each deflection rib 50 of the body 20 on the interior surface 48 of the fourth wall 38 of the body 20, at ends thereof, respectively.

The panel 66 of the electrical circuitry 22 is black for accentuating the flash of each light 24.

Figure 7:
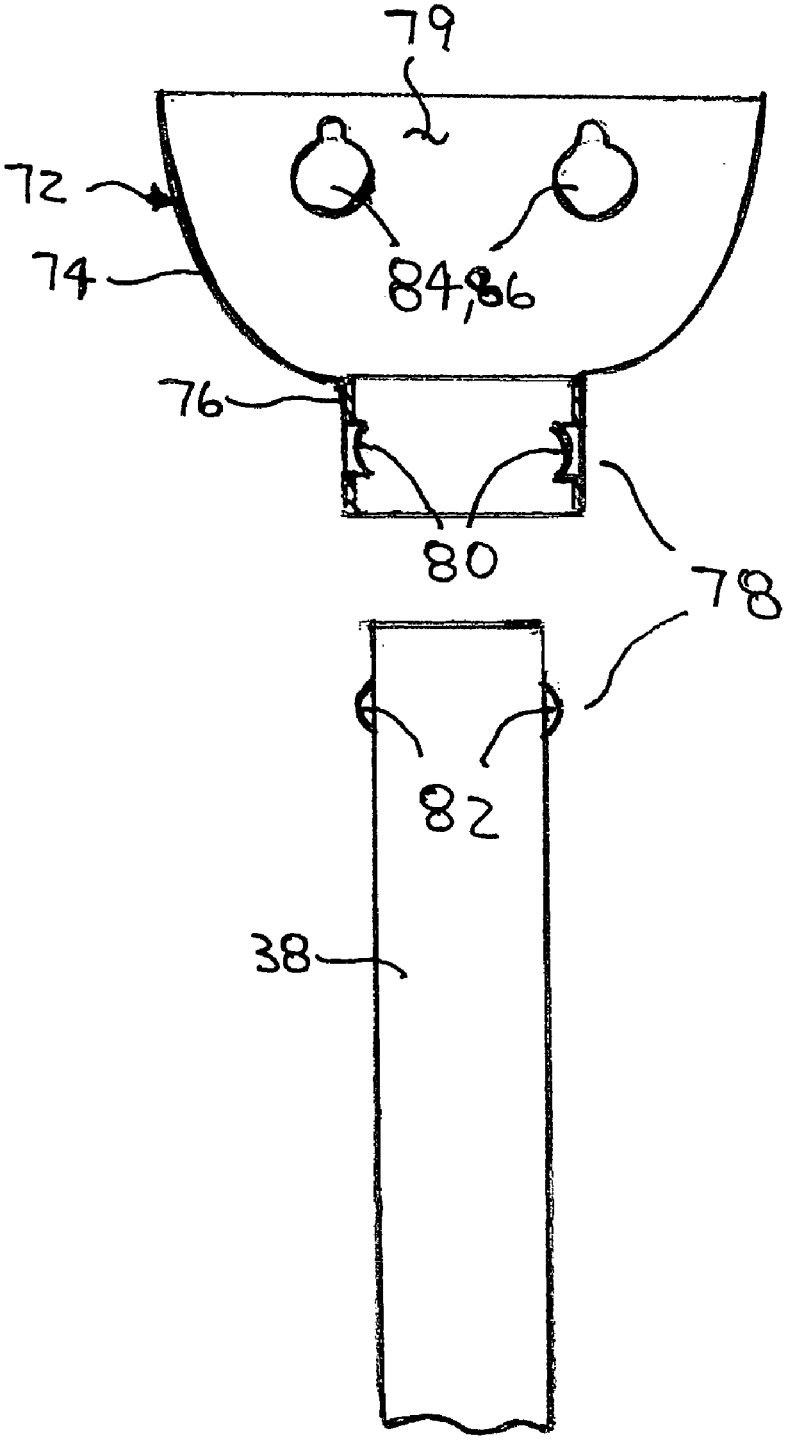
FIG. 7 is an enlarged rear elevational view taken generally in the direction of ARROW 7 in FIG. 2 of the head of the novelty item of the present invention, the apparatus to attach the head of the novelty item of the present invention to the body of the novelty item of the present invention, and the apparatus to mount the novelty item of the present invention to a vertical surface.

As shown on FIG. 7, which is an enlarged rear elevational view taken generally in the direction of ARROW 7 in FIG. 2 of the head of the novelty item of the present invention, the attaching apparatus to attach the head of the novelty item of the present invention to the body of the novelty item of the present invention, and the mounting apparatus to mount the novelty item of the present invention to a vertical surface, the novelty item 10 further comprises a head 72.

The head 72 is replaceably attached to, and communicates with, the uppermost end 26 of the body 20, and comprises a body 74 and a collar 76. The collar 76 of the head 72 depends from the body 74 of the head 72 and replaceably receives the uppermost end 26 of the body 20 by attaching apparatus 78.

The body 74 of the head 72 flares upwardly to facilitate capturing of the cap 12 as a funnel would do, but has a surface 79 that is substantially coplanar with the fourth wall 38 of the body 20.

The attaching apparatus 78 comprises a female portion 80 and a male portion 82. The female portion 80 of the attaching apparatus 78 extends inwardly in the collar 76 of the head 70 and the male portion 82 of the attaching apparatus 78 extends outwardly from the uppermost end 26 of the body 20 and is snapingly captured in the female portion 80 of the attaching apparatus 78.

The novelty item 10 further comprises mounting apparatus 84. The mounting apparatus 84 comprises the surface 79 of the body 74 of the head 72 having a pair of through bores 86. The pair of through bores 86 in the surface 79 of the body 74 of the head 72 are inverted teardrop-shaped for capturing the heads of a pair of nails/screws or the like (not shown), respectively.

It is to be understood that the novelty item 10 can work with any item that is similar to the cap 12, i.e., a disk, e.g., a 25¢ piece, and thereby would eliminate a need for the bottle opener 16. The cap catcher 18 is placed on a bar with the novelty item 10 resting thereon and thereabove. A patron throws 25¢ pieces into the novelty item 10 as a tip and watches the 25¢ pieces cause the novelty item 10 to operate as it would with the cap 12 of the bottle 14.

It will be understood that each of the elements described above, or two or more together, may also find a useful application in other types of constructions differing from the types described above.

While the invention has been illustrated and described as embodied in a novelty item for cooperating with a cap of a bottle subsequent to cooperation of the cap with a bottle opener but prior to cooperation of the cap with a cap catcher, it is not limited to the details shown, since it will be understood that various omissions, modifications, substitutions, and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of the invention.

The invention claimed is:

1. A novelty item for cooperating with a disk, said novelty item comprising:

a body;

electrical circuitry; and a plurality of lights;

said electrical circuitry electrically communicating with said plurality of lights;

said plurality of lights being disposed along said body; and said electrical circuitry causing a light to flash, said body being elongated, said body being square-shaped in lateral cross section, said body being vertically-oriented and hollow for allowing the disk to fall therethrough by gravity, said body having an uppermost end, said body having a lowermost end, said uppermost end of said body being open and said lowermost end of said body being open for allowing the disk to enter said body through said uppermost end of said body and then exiting said body through said lowermost end of said body, said body having four walls, said four walls of said body being so positioned so as to provide said square-shaped lateral cross section, said four walls of said body including a first wall, said four walls of said body including a second wall, said four walls of said body including a third wall, said four walls of said body including a fourth wall, said first wall of said body having an interior surface, said second wall of said body having an interior surface, said third wall of said body having an interior surface, said fourth wall of said body having an interior surface, said body having a plurality of deflection ribs, said plurality of deflection ribs of said body extending along said interior surface of said first wall of said body, said plurality of deflection ribs of said body extending along said interior surface of said second wall of said body, said plurality of deflection ribs of said body extending along said interior surface of said third wall of said body, said plurality of deflection ribs of said body extending along said interior surface of said fourth wall of said body, an uppermost deflection rib of said body on said interior surface of said first wall of said body being positioned ½" below said uppermost end of said body, and remaining deflection ribs of said body on said interior surface of said first wall of said body being positioned at 1½" intervals below said uppermost deflection rib of said body on said interior surface of said first wall of said body.

2. The novelty item as defined in claim 1, wherein said four walls of said body are oriented with said first wall of said body and said third wall of said body opposing each other; and said four walls of said body are oriented with said second wall of said body and said fourth wall of said body opposing each other.

3. The novelty item as defined in claim 1, wherein each deflection rib of said body is slender;

each deflection rib of said body is elongated;

each deflection rib of said body is horizontally-oriented; and each deflection rib of said body is spaced-apart from an adjacent deflection rib of said body.

4. The novelty item as defined in claim 1, wherein said plurality of deflection ribs of said body are so positioned along said interior surface of said first wall of said body, said interior surface of said second wall of said body, said interior surface of said third wall of said body, and said interior surface of said fourth wall of said body so as to cause the disk to contact them and ricochet thereoff as the disk travels down said body, with said electrical circuitry causing a light to flash.

5. The novelty item as defined in claim 1, wherein said plurality of lights are LEDs.

6. The novelty item as defined in claim 1, further comprising a head;

said head is replaceably attached to said uppermost end of said body; and said head communicates with said uppermost end of said body.

7. The novelty item as defined in claim 6, wherein said head comprises a body; and said head comprises a collar.

8. The novelty item as defined in claim 7, wherein said collar of said head depends from said body of said head; and said collar of said head replaceably receives said uppermost end of said body by attaching apparatus.

9. The novelty item as defined in claim 7, wherein said body of said head flares upwardly to facilitate capturing of the disk as a funnel would do;

said body of said head has a surface; and said surface of said body of said head is substantially coplanar with said fourth wall of said body.

10. The novelty item as defined in claim 9, wherein said attaching apparatus comprises a female portion;

said attaching apparatus comprises a male portion.

11. The novelty item as defined in claim 10, wherein said female portion of said attaching apparatus extends inwardly in said collar of said head;

said male portion of said attaching apparatus extends outwardly from said uppermost end of said body; and said male portion of said attaching apparatus is snapingly captured in said female portion of said attaching apparatus.

12. The novelty item as defined in claim 9, further comprising a mounting apparatus;

said mounting apparatus comprises said surface of said body of said head having a pair of through bores; and said pair of through bores in said surface of said body of said head are for capturing heads of a pair of nails/screws, respectively.

13. The novelty item as defined in claim 12, wherein said pair of through bores in said surface of said body of said head are inverted teardrop-shaped.

14. A novelty item for cooperating with a disk, said novelty item comprising:

a body, electrical circuitry, and a plurality of lights, said electrical circuitry electrically communicating with said plurality of lights, said plurality of lights being disposed along said body, said electrical circuitry causing a light to flash, said body being elongated, said body being square-shaped in lateral cross section, said body being vertically-oriented and hollow for allowing the disk to fall therethrough by gravity, said body having an uppermost end, said body having a lowermost end, said uppermost end of said body being open and said lowermost end of said body being open for allowing the disk to enter said body through said uppermost end of said body and then exiting said body through said lowermost end of said body, said body having four walls, said four walls of said body being so positioned so as to provide said square-shaped lateral cross section, said four walls of said body including a first wall, said four walls of said body including a second wall, said four walls of said body including a third wall, said four walls of said body including a fourth wall, said first wall of said body having an interior surface, said second wall of said body having an interior surface, said third wall of said body having an interior surface, said fourth wall of said body having an interior surface, said body having a plurality of deflection ribs, said plurality of deflection ribs of said body extending along said interior surface of said first wall of said body, said plurality of deflection ribs of said body extending along said interior surface of said second wall of said body, said plurality of deflection ribs of said body extending along said interior surface of said third wall of said body, said plurality of deflection ribs of said body extending along said interior surface of said fourth wall of said body, an uppermost deflection rib of said body on said interior surface of said second wall of said body being positioned ¾" below said uppermost end of said body; and remaining deflection ribs of said body on said interior surface of said second wall of said body being positioned at 1" intervals below said uppermost deflection rib of said body on said interior surface of said second wall of said body.

15. A novelty item for cooperating with a disk, said novelty item comprising:

a body, electrical circuitry, and a plurality of lights, said electrical circuitry electrically communicating with said plurality of lights, said plurality of lights being disposed along said body, said electrical circuitry causing a light to flash, said body being elongated, said body being square-shaped in lateral cross section, said body being vertically-oriented and hollow for allowing the disk to fall therethrough by gravity, said body having an uppermost end, said body having a lowermost end, said uppermost end of said body being open and said lowermost end of said body being open for allowing the disk to enter said body through said uppermost end of said body and then exiting said body through said lowermost end of said body, said body having four walls, said four walls of said body being so positioned so as to provide said square-shaped lateral cross section, said four walls of said body including a first wall said four walls of said body including a second wall, said four walls of said body including a third wall, said four walls of said body including a fourth wall, said first wall of said body having an interior surface, said second wall of said body having an interior surface, said third wall of said body having an interior surface, said fourth wall of said body having an interior surface, said body having a plurality of deflection ribs, said plurality of deflection ribs of said body extending along said interior surface of said first wall of said body, said plurality of deflection ribs of said body extending along said interior surface of said second wall of said body, said plurality of deflection ribs of said body extending along said interior surface of said third wall of said body, said plurality of deflection ribs of said body extending along said interior surface of said fourth wall of said body, an uppermost deflection rib of said body on said interior surface of said third wall of said body being positioned 1" below said uppermost end of said body; and remaining deflection ribs of said body on said interior surface of said third wall of said body being positioned at 1½" intervals below said uppermost deflection rib of said body on said interior surface of said third wall of said body.

16. A novelty item for cooperating with a disk, said novelty item comprising:

a body, electrical circuitry, and a plurality of lights, said electrical circuitry electrically communicating with said plurality of lights, said plurality of lights being disposed along said body, said electrical circuitry causing a light to flash, said body being elongated, said body being square-shaped in lateral cross section, said body being vertically-oriented and hollow for allowing the disk to fall therethrough by gravity, said body having an uppermost end, said body having a lowermost end, said uppermost end of said body being open and said lowermost end of said body being open for allowing the disk to enter said body through said uppermost end of said body and then exiting said body through said lowermost end of said body, said body having four walls, said four walls of said body being so positioned so as to provide said square-shaped lateral cross section, said four walls of said body including a first wall, said four walls of said body including a second wall, said four walls of said body including a third wall, said four walls of said body including a fourth wall, said first wall of said body having an interior surface, said second wall of said body having an interior surface, said third wall of said body having an interior surface, said fourth wall of said body having an interior surface, said body having a plurality of deflection ribs, said plurality of deflection ribs of said body extending along said interior surface of said first wall of said body, said plurality of deflection ribs of said body extending along said interior surface of said second wall of said body, said plurality of deflection ribs of said body extending along said interior surface of said third wall of said body, said plurality of deflection ribs of said body extending along said interior surface of said fourth wall of said body, an uppermost deflection rib of said body on said interior surface of said fourth wall of said body being positioned ¾" below said uppermost end of said body; and remaining deflection ribs of said body on said interior surface of said fourth wall of said body being positioned at 1" intervals below said uppermost deflection rib of said body on said interior surface of said fourth wall of said body.

17. A novelty item for cooperating with a disk, said novelty item comprising:

a body, electrical circuitry, and a plurality of lights, said electrical circuitry electrically communicating with said plurality of lights, said plurality of lights being disposed along said body, said electrical circuitry causing a light to flash, said body being elongated, said body being square-shaped in lateral cross section, said body being vertically-oriented and hollow for allowing the disk to fall therethrough by gravity, said body having an uppermost end, said body having a lowermost end, said uppermost end of said body being open and said lowermost end of said body being open for allowing the disk to enter said body through said uppermost end of said body and then exiting said body through said lowermost end of said body, said body having four walls, said four walls of said body being so positioned so as to provide said square-shaped lateral cross section, said four walls of said body including a first wall, said four walls of said body including a second wall, said four walls of said body including a third wall, said four walls of said body including a fourth wall, said first wall of said body having an interior surface, said second wall of said body having an interior surface, said third wall of said body having an interior surface, said fourth wall of said body having an interior surface, said body having a plurality of deflection ribs, said plurality of deflection ribs of said body extending along said interior surface of said first wall of said body, said plurality of deflection ribs of said body extending along said interior surface of said second wall of said body, said plurality of deflection ribs of said body extending along said interior surface of said third wall of said body, said plurality of deflection ribs of said body extending along said interior surface of said fourth wall of said body, each deflection rib of said body having a lateral cross sectional shape for facilitating the ricocheting, said lateral cross sectional shape of each deflection rib of said body being one of generally hemispherical and tapered.

18. A novelty item for cooperating with a disk, said novelty item comprising:

a body, electrical circuitry, and a plurality of lights, said electrical circuitry electrically communicating with said plurality of lights, said plurality of lights being disposed along said body, said electrical circuitry causing a light to flash, said body being elongated, said body being square-shaped in lateral cross section, said body being vertically-oriented and hollow for allowing the disk to fall therethrough by gravity, said body having an uppermost end, said body having a lowermost end, said uppermost end of said body being open and said lowermost end of said body being open for allowing the disk to enter said body through said uppermost end of said body and then exiting said body through said lowermost end of said body, said body having four walls, said four walls of said body being so positioned so as to provide said square-shaped lateral cross section, said four walls of said body including a first wall, said four walls of said body including a second wall, said four walls of said body including a third wall, said four walls of said body including a fourth wall, said first wall of said body having an interior surface, said second wall of said body having an interior surface, said third wall of said body having an interior surface, said fourth wall of said body having an interior surface, said body having a plurality of deflection ribs, said plurality of deflection ribs of said body extending along said interior surface of said first wall of said body, said plurality of deflection ribs of said body extending along said interior surface of said second wall of said body, said plurality of deflection ribs of said body extending along said interior surface of said third wall of said body, said plurality of deflection ribs of said body extending along said interior surface of said fourth wall of said body, said deflection ribs of said body on said interior surface of said second wall of said body and said deflection ribs of said body on said interior surface of said fourth wall of said body having one-to-one correspondence elevations.

19. A novelty item for cooperating with a disk, said novelty item comprising:

a body, electrical circuitry, and a plurality of lights, said electrical circuitry electrically communicating with said plurality of lights, said plurality of lights being disposed along said body, said electrical circuitry causing a light to flash, said body being elongated, said body being square-shaped in lateral cross section, said body being vertically-oriented and hollow for allowing the disk to fall therethrough by gravity, said body having an uppermost end, said body having a lowermost end, said uppermost end of said body being open and said lowermost end of said body being open for allowing the disk to enter said body through said uppermost end of said body and then exiting said body through said lowermost end of said body, said body having four walls, said four walls of said body being so positioned so as to provide said square-shaped lateral cross section, said four walls of said body including a first wall, said four walls of said body including a second wall, said four walls of said body including a third wall, said four walls of said body including a fourth wall, said first wall of said body having an interior surface, said second wall of said body having an interior surface, said third wall of said body having an interior surface, said fourth wall of said body having an interior surface, said body having a plurality of deflection ribs, said plurality of deflection ribs of said body extending along said interior surface of said first wall of said body, said plurality of deflection ribs of said body extending along said interior surface of said second wall of said body, said plurality of deflection ribs of said body extending along said interior surface of said third wall of said body, said plurality of deflection ribs of said body extending along said interior surface of said fourth wall of said body, said electrical circuitry including a PC board; and said PC board of said electrical circuitry being spaced behind said fourth wall of said body;

said PC board of said electrical circuitry extending along said fourth wall of said body.

20. The novelty item as defined in claim 19, wherein said electrical circuitry comprises an optical or proximity sensor;

said optical or proximity sensor of said electrical circuitry is disposed on said PC board of said electrical circuitry;

said optical or proximity sensor of said electrical circuitry is disposed at an elevation of said uppermost end of said body; and said optical or proximity sensor of said electrical circuitry activates said electrical circuitry when triggered by the disk passing thereby.

21. The novelty item as defined in claim 20, wherein said electrical circuitry comprises a controller;

said controller of said electrical circuitry is disposed on said PC board of said electrical circuitry; and said controller of said electrical circuitry electrically communicates with said optical or proximity sensor of said electrical circuitry.

22. The novelty item as defined in claim 21, wherein said electrical circuitry comprises a light driver;

said light driver of said electrical circuitry is disposed on said PC board of said electrical circuitry;

said light driver of said electrical circuitry electrically communicates with said controller of said electrical circuitry; and said light driver of said electrical circuitry electrically communicates with said plurality of lights.

23. The novelty item as defined in claim 22, wherein said electrical circuitry comprises a power supply interface;

said power supply interface of said electrical circuitry is disposed on said PC board of said electrical circuitry;

said power supply interface of said electrical circuitry electrically communicates with said optical or proximity sensor of said electrical circuitry;

said power supply interface of said electrical circuitry electrically communicates with said controller of said electrical circuitry;

said power supply interface of said electrical circuitry electrically communicates with said light driver of said electrical circuitry; and said power supply interface of said electrical circuitry electrically communicates with said plurality of lights.

24. The novelty item as defined in claim 21, wherein said electrical circuitry comprises a cover;

said cover of said electrical circuitry replaceably attaches to said fourth wall of said body; and said cover of said electrical circuitry covers, so as to protect, said electrical circuitry.

25. The novelty item as defined in claim 24, wherein said electrical circuitry comprises a pattern select switch;

said pattern select switch of said electrical circuitry is disoposed on said PC board of said electrical circuitry;

said pattern select switch of said electrical circuitry electrically communicates with said controller of said electrical circuitry;

said pattern select switch of said electrical circuitry extends through said cover of said electrical circuitry; and said pattern select switch of said electrical circuitry selectively changes pattern of illumination of said plurality of lights if desired.

26. The novelty item as defined in claim 22, wherein said electrical circuitry comprises a panel;

said panel of said electrical circuitry is disposed between said PC board of said electrical circuitry and said fourth wall of said body; and said panel of said electrical circuitry is disposed along said fourth wall of said body.

27. The novelty item as defined in claim 26, wherein said panel of said electrical circuitry has a plurality of through bores.

28. The novelty item as defined in claim 27, wherein said fourth wall of said body has a plurality of through bores.

29. The novelty item as defined in claim 28, wherein said plurality of through bores in said fourth wall of said body are in one-to-one alignment with said plurality of through bores in said panel of said electrical circuitry.

30. The novelty item as defined in claim 28, wherein said plurality of lights are disposed on said PC board of said electrical circuitry;

said plurality of lights electrically communicate with said light driver of said electrical circuitry; and said plurality of lights extend inwardly from said PC board of said electrical circuitry, through said plurality of through bores in said panel of said electrical circuitry that are aligned therewith, through said plurality of through bores in said fourth wall of said body, and into said deflection ribs of said body on said interior surface of said fourth wall of said body.

31. The novelty item as defined in claim 26, wherein said panel of said electrical circuitry is black for accentuating the flash of each light.

32. A novelty item for cooperating with a disk said novelty item comprising:

a body, electrical circuitry, and a plurality of lights, said electrical circuitry electrically communicating with said plurality of lights, said plurality of lights being disposed along said body, said electrical circuitry causing a light to flash, said body being elongated, said body being square-shaped in lateral cross section, said body being vertically-oriented and hollow for allowing the disk to fall therethrough by gravity, said body having an uppermost end, said body having a lowermost end, said uppermost end of said body being open and said lowermost end of said body being open for allowing the disk to enter said body through said uppermost end of said body and then exiting said body through said lowermost end of said body, said body having four walls, said four walls of said body being so positioned so as to provide said square-shaped lateral cross section, said four walls of said body including a first wall, said four walls of said body including a second wall, said four walls of said body including a third wall, said four walls of said body including a fourth wall, said first wall of said body having an interior surface, said second wall of said body having an interior surface, said third wall of said body having an interior surface, said fourth wall of said body having an interior surface, said body having a plurality of deflection ribs, said plurality of deflection ribs of said body extending along said interior surface of said first wall of said body, said plurality of deflection ribs of said body extending along said interior surface of said second wall of said body, said plurality of deflection ribs of said body extending along said interior surface of said third wall of said body, said plurality of deflection ribs of said body extending along said interior surface of said fourth wall of said body, said plurality of lights are so arranged so as to allow a pair of lights to be disposed on each deflection rib of said body on said interior surface of said fourth wall of said body; and each pair of lights are disposed at ends of each deflection rib of said body on said interior surface of said fourth wall of said body, respectively.

* * * * *